US006152438A

United States Patent [19]

Morgan

[11] Patent Number: 6,152,438

[45] Date of Patent: Nov. 28, 2000

[54] FLOOR SUPPORTED FABRIC SPREADING MACHINE

[76] Inventor: Wade Morgan, 1611 Fabricon Blvd., Jeffersonville, Ind. 47130

[21] Appl. No.: 08/898,988

[22] Filed: Jul. 23, 1997

[51] Int. Cl.[7] ..... B65H 29/46

[52] U.S. Cl. ..... 270/30.01; 270/30.08; 270/30.05; 270/30.11; 270/30.12; 270/30.13; 83/56

[58] Field of Search ..... 270/30.11, 30.1, 270/30.12, 30.13, 30.01, 30.05, 30.06, 31, 30.08, 30.09; 83/56; 104/29

[56] References Cited

U.S. PATENT DOCUMENTS

| | | | |
|---|---|---|---|
| 2,670,040 | 2/1954 | Sayles | 270/30.09 |
| 3,145,989 | 8/1964 | Cavrich | 270/31 |
| 3,502,320 | 3/1970 | Scordato | 270/30.11 |
| 3,503,605 | 3/1970 | Stumpf et al. | 270/30.11 |
| 3,586,318 | 6/1971 | Reckdahl | 271/42 |
| 3,645,524 | 2/1972 | Grimm et al. | 270/30.07 |
| 3,735,974 | 5/1973 | Stumpf | 270/30.06 |
| 3,778,050 | 12/1973 | Grimm et al. | 270/31 |
| 3,779,541 | 12/1973 | Stumpf | 270/30.11 |
| 3,941,366 | 3/1976 | Feld | 270/31 |
| 4,021,029 | 5/1977 | Rice | 270/31 |
| 4,033,573 | 7/1977 | Wortman | 270/30.04 |
| 4,073,206 | 2/1978 | Gratsch et al. | 83/489 |
| 4,155,543 | 5/1979 | Costigan | 270/30.05 |
| 4,193,589 | 3/1980 | Frederick | 270/30.11 |
| 4,355,794 | 10/1982 | Costigan | 270/31 |
| 4,380,330 | 4/1983 | Smith et al. | 83/484 |
| 4,475,729 | 10/1984 | Costigan | 270/31 |
| 4,483,652 | 11/1984 | Barry | 414/392 |
| 4,516,760 | 5/1985 | Stumpf | 270/31 |
| 4,519,595 | 5/1985 | Adachi | 270/30.11 |
| 4,572,495 | 2/1986 | Stumpf | 270/31 |
| 4,573,618 | 3/1986 | Kikuchi | 270/30.11 |
| 4,589,644 | 5/1986 | Gratsch | 270/31 |
| 4,595,328 | 6/1986 | Seitz et al. | 270/30.11 |
| 4,611,798 | 9/1986 | Hoffman et al. | 270/30.11 |
| 4,676,494 | 6/1987 | Smith et al. | 270/30.01 |
| 4,728,089 | 3/1988 | Barrett | 270/30.11 |
| 4,747,329 | 5/1988 | Lukens, Jr. | 83/29 |
| 4,781,366 | 11/1988 | Tagawa | 270/30.11 |
| 4,982,940 | 1/1991 | Jung | 270/30.08 |
| 5,024,429 | 6/1991 | Etcheparre et al. | 270/30.05 |
| 5,236,184 | 8/1993 | Cattini | 270/30.11 |
| 5,289,748 | 3/1994 | Kuchta et al. | 83/56 |
| 5,447,296 | 9/1995 | Cox | 270/30.13 |
| 5,503,082 | 4/1996 | Bosma | 104/29 |

OTHER PUBLICATIONS

Brochures concerning Eastman's Spreading Machines.

*Primary Examiner*—Christopher P. Ellis
*Assistant Examiner*—Michael E. Butler
*Attorney, Agent, or Firm*—Scott R. Cox

[57] ABSTRACT

A fabric spreading machine including a dispensing system frame, a fabric dispensing assembly secured to the frame, a floor mounted track and a drive system secured to the frame for traversing the track. Also disclosed is a loading and unloading system for loading and unloading a fabric roll and securing it to the dispensing system frame. This system is designed to permit fabric to be dispensed from a fabric roll onto a conventional fabric spreading table without placing the weight of the fabric spreading machine directly on the fabric spreading table.

13 Claims, 3 Drawing Sheets

FLOOR SUPPORTED FABRIC SPREADING MACHINE

BACKGROUND OF THE INVENTION

This invention relates to fabric spreading machines and more particularly to a fabric spreading machine supported on a floor for spreading stacked lengths of fabric on a conventional fabric spreading table.

Various types of fabric spreading machines have been utilized for supporting and feeding a series of webs of fabric from a fabric roll onto a fabric spreading table. These machines are designed to place a consistent length of fabric at a consistent location on a fabric spreading table. Conventionally, fabric spreading machines utilize equipment designed to spread the fabric on custom-made fabric spreading table. Conventional fabric spreading machines are supported by the table and move across the top surface of the table, either manually or by a mechanized drive system, to spread the fabric in flat, stacked layers. These spreading tables may range in length from 20 feet to as long as 200 feet. Fabric spreading machines of this type are disclosed, for example, in U.S. Pat. Nos. 4,781,366, 4,676,494 and 3,645,524. These fabric spreading machines incorporate an assembly to support the roll of fabric and a system to move the fabric spreading equipment across the top of the fabric spreading table as shown, for example, in a series of fabric spreading machines manufactured by Eastman Cutting Room Sales.

The fabric spreading tables and the fabric spreading machines used on those tables are often limited in the amount of fabric that can be spread by the weight of the equipment and fabric which can be supported by the fabric spreading table. This weight problem is not solved merely by using smaller rolls of fabric as this alternative results in increased down time each time an empty fabric roll must be replaced and a new fabric roll must be installed.

An additional difficulty associated with conventional fabric spreading machines which are secured on the top of a fabric spreading table is the cost of building a table that will support the weight of the fabric spreading equipment, the fabric roll to be spread and the length of fabric already spread. Because the total weight of both the equipment and the fabric roll can be several thousand pounds, specially designed fabric spreading tables must be constructed, which may cost hundreds of thousands of dollars.

One system disclosed in U.S. Pat. No. 5,024,429 attempts to overcome these difficulties by utilizing a stationary fabric supply unit which operates with a separate fabric spreading equipment, which equipment moves across, and is supported by, the fabric spreading table. Another system disclosed in U.S. Pat. No. 5,447,296 uses a stationary supply of fabric and a support for the unrolled fabric separated from the fabric spreading table, a fabric spreading machine placed on the fabric spreading table and an overhead fabric supporting delivery assembly designed to deliver the fabric to the spreading machine. A similar fabric spreading system is disclosed in an advertisement for the Eastman FLOW system sold by Eastman Cutting Room Sales Corporation. While this system has been successful in solving some of the problems associated with heavy fabric spreading equipment, problems still exist because the disclosed spreading machine is still supported by the fabric spreading table. Further, this system requires a complicated structural framework to support the fabric conveyor rollers which carry the fabric to the fabric spreading machine. This system must also be closely monitored to maintain synchronization of the spreading machine with the dispensing of the fabric from the fabric roll. While the use of a stationary fabric roll located apart from the fabric spreading table reduces the weight that must be supported by the table, additional problems are still encountered by this design associated with the tension that must be maintained on the fabric and the edge alignment of the fabric on the fabric spreading table. In order for this type of fabric spreading equipment to function properly, the operator must carefully monitor the fabric as it is placed on the fabric spreading table.

Many prior art systems that utilize a fixed location for the fabric roll have encountered problems with precise edge control, uniform tension on the fabric and maintenance of these conditions over the length of the spreading table. Each layer of the fabric must be carefully placed on the table at a consistent location so that several layers of the fabric may be cut at the same time.

Accordingly, it is an aspect of the invention to provide a fabric spreading machine which spreads fabric evenly over a conventional fabric spreading table from a conventional fabric roll.

Yet another aspect of the invention is a fabric spreading machine which reduces the amount of weight that must be supported by the fabric spreading table.

Another aspect of the invention is a fabric spreading system supported on a dispensing system frame for spreading fabric on a fabric spreading table.

Another aspect of the invention is a fabric spreading machine supported on a dispensing system frame which rolls along a track secured to a floor for dispensing fabric onto a fabric spreading table.

A further aspect of the invention is a fabric spreading machine with a drive unit to move a dispensing system frame which supports the fabric roll as the fabric is dispensed onto the fabric spreading table.

A still further aspect of the invention is a system to load and unload rolls of fabric onto the frame for the fabric spreading machine.

Still another aspect of the invention is a fabric spreading machine where the rolls of fabric may be easily replaced.

These and other aspects and features of the present invention will become apparent to those skilled in the art from a consideration of the following detailed description, drawings and claims. The description, along with the accompanying drawings, provides a selected example of construction of the device to illustrate the invention.

SUMMARY OF INVENTION

In accordance with the present invention there is provided a fabric spreading machine comprising a dispensing system frame, a fabric dispensing assembly secured to the frame, a floor mounted track on which the dispensing system frame moves and a drive system secured to the frame to permit the frame to travel on the floor mounted track.

In addition, in a preferred embodiment a loading and unloading system for loading and unloading rolls of fabric onto the frame is secured to the frame.

A further preferred embodiment discloses a fabric dispensing drive secured to the frame for dispensing the fabric from a fabric roll at a regular rate across a conventional fabric spreading table.

BRIEF DESCRIPTION OF THE DRAWINGS

This invention will now be described with reference to the accompanying drawings in which.

DETAILED DESCRIPTION OF THE PREFERRED EMBODIMENT

Figure 1:
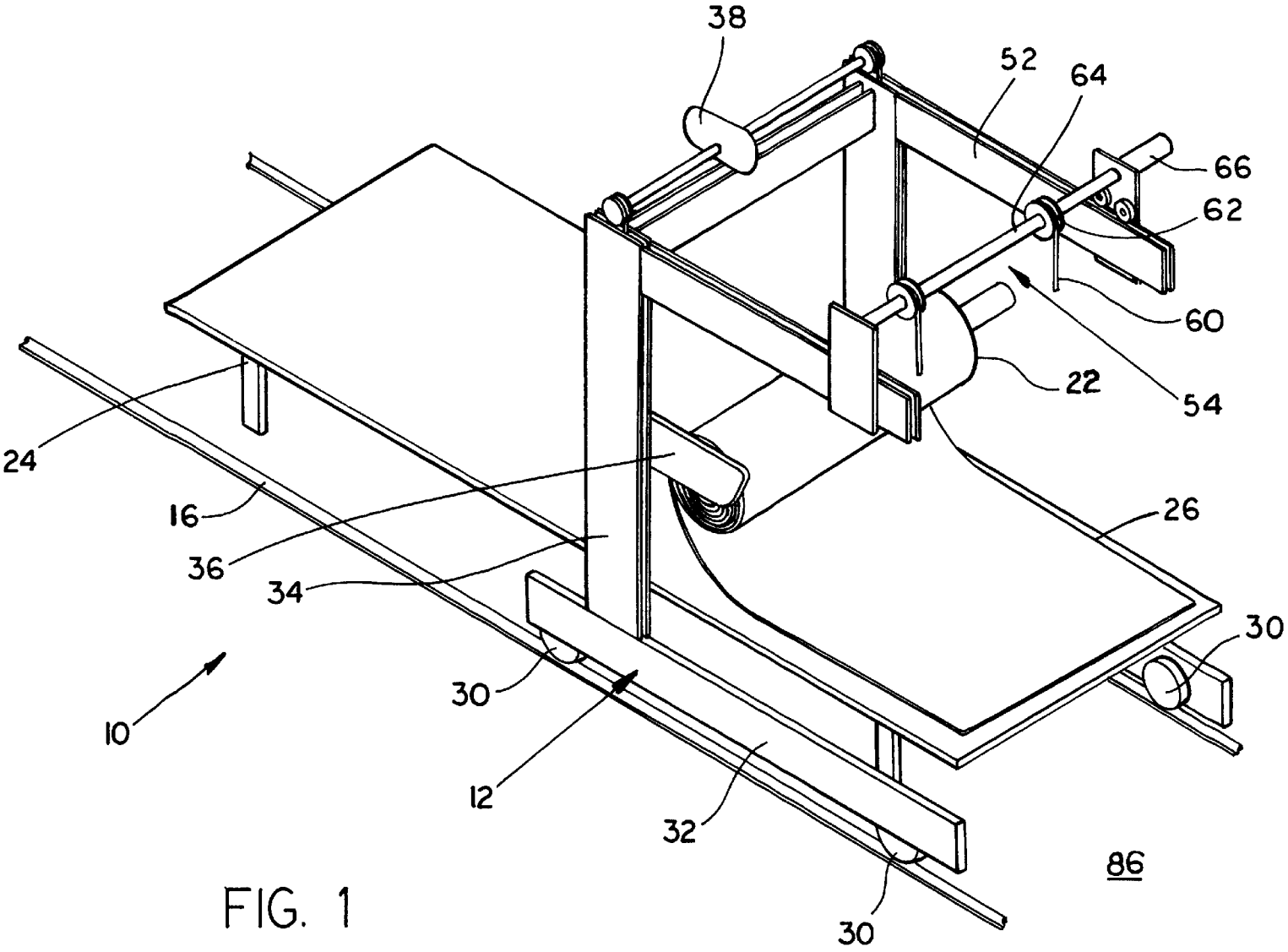
FIG. 1 is a perspective view of the fabric spreading machine of the present invention.

The fabric spreading machine (10) of the present invention as shown in FIG. 1 includes a dispensing system frame (12), a fabric dispensing assembly (14), secured to the dispensing system frame (12), a floor mounted track (16) and a drive system secured to the dispensing system frame (12) for moving the dispensing system frame (12) along the floor mounted track (16). Preferably, a loading and unloading system (20) for loading fabric rolls (22) onto the dispensing system frame (12) is also secured to the dispensing system frame (12). The fabric spreading machine (10) is used with a conventional fabric spreading table (24) to support the fabric (26) as it is being dispensed.

The dispensing system frame (12) includes a system for supporting the fabric roll (22), a system for dispensing the fabric (26) onto the fabric support table (24), and a track traversing drive system for moving the dispensing system frame on the floor mounted track (16). In a preferred embodiment, the dispensing system frame (12) also includes the loading and unloading system (20) for loading and unloading fabric rolls (22).

The dispensing system frame (12) as shown in FIG. 1 generally includes any track traversing drive system which cooperates with the floor mounted track (16) to permit the dispensing system frame (12) to roll consistently across the floor (86) with the fabric roll (22) secured above the fabric support table (24). In one preferred embodiment this track traversing drive system for controlling the movement of the dispensing system frame (12) includes a group of pairs of carrier wheels (30) secured to the frame (12), preferably at least two pair of wheels (30), and more preferably as many pairs as are necessary to support the dispensing system frame (12) in use. In one preferred embodiment the carrier wheels (30) are about 3 inches in diameter "V" grooved wheels, such as VCF Series Trakrol bearing wheels manufactured by McGill® Precision Bearings.

These "V" grooved carrier wheels (30) are interconnected with other carrier wheels (30) of the track traversing drive system by conventional sprockets, chains and axles (not shown), such as those manufactured by Browning Manufacturing of Maysville, Ky. and from the components of the drive system which also includes a conventional drive motor (38) such as is manufactured by Browning Manufacturing for driving the carrier wheels (30). This drive system has similarities with conventional drive systems that are used with conventional fabric spreading equipment except that instead of the carrier wheels which support the fabric spreaders running on a track secured to the top of the fabric spreading table, the drive system moves the dispensing system frame (12) on a track (16) secured to the floor (86) of the building which houses the fabric spreading machine (10).

In the present invention the carrier wheels (30) are connected by sprockets and gear chains (not shown) to a gear box (not shown) and a pulley chain (not shown) which is driven by the dispensing system drive motor (38) which is secured to the dispensing system frame (12), which motor (38) drives the dispensing system frame (12) along the tracks (16). The type of drive system drive motor (38) for driving the carrier wheels (30) along the track (16) is conventional, such as is manufactured by Browning Manufacturing of Maysville, Ky.

The individual carrier wheels (30), sprockets, gears, pulleys and axles (not shown) are also conventional, but their combination is different from that used with a conventional fabric spreading machine. Instead of moving the fabric spreading machine (10) across the surface of the table (24), the motor (38) moves the dispensing system frame (12), which supports the various elements of the invention, along the track (16) secured to the floor (86).

In one preferred embodiment, the carrier wheels (30) on one side of the dispensing system frame (12) are rotatably attached to a horizontal frame member (32) as shown in FIG. 1. The carrier wheels (30), rotatably attached to one side of the horizontal frame member (32) are attached by a conventional axle (not shown) to cooperating carrier wheels (not shown) on the opposite side of the frame (12). The carrier wheels (30) move down the track (16) in unison as a result of the cooperating chains and axles which link them together, all of which are conventional (not shown). This horizontal frame member (32) is constructed of conventional materials, such as a conventional rectangular tubing, manufactured from aluminum or steel.

Attached to this horizontal frame member (32) in one preferred embodiment is a vertical frame member (34), which is secured to the horizontal frame member (32) by conventional securing systems, such as bolts or by welding. This vertical frame member (34) supports a portion of the track traversing drive system for driving the carrier wheels (30) of the dispensing system frame (12) along the tracks (16). This vertical frame member (34) is also constructed of conventional materials similar to those of the horizontal frame member (32).

Figure 2:
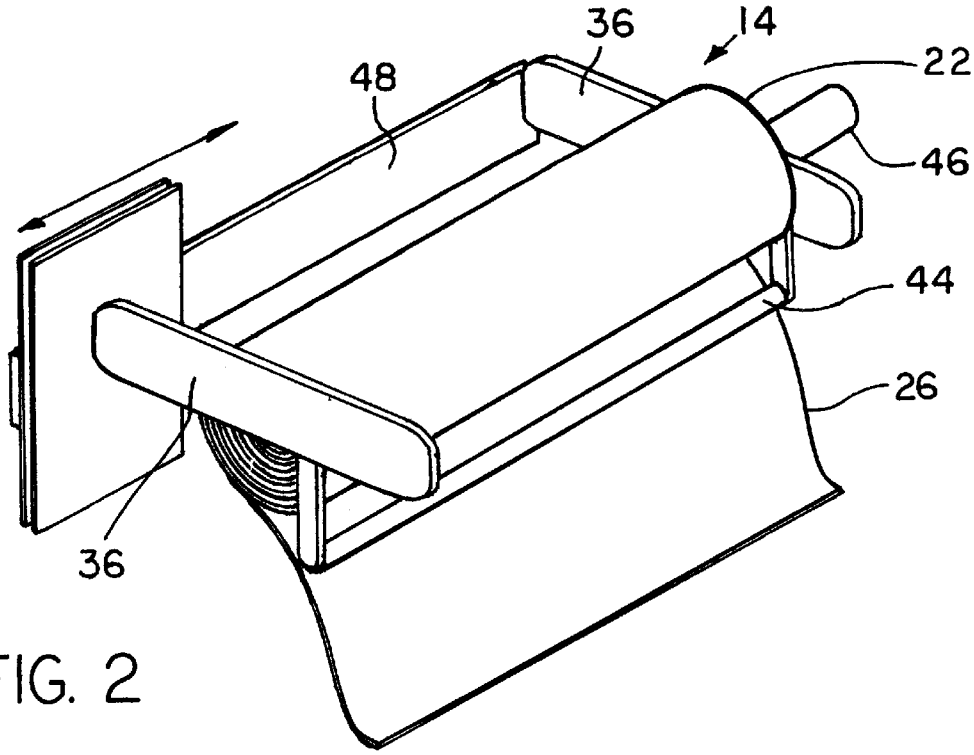
FIG. 2 is a perspective view of the fabric dispensing assembly of the fabric spreading machine of the present invention.

Secured to this vertical frame member (34) are a pair of fabric dispensing support arms (36) for supporting both sides of the fabric dispensing assembly (14) as shown in FIG. 2. These fabric dispensing support arms (36) for supporting the fabric dispensing assembly (14) are secured to the vertical frame member (34) by conventional securing methods, as discussed above, and are constructed of materials similar to those of the remaining components of the dispensing system frame (12).

Figure 3:
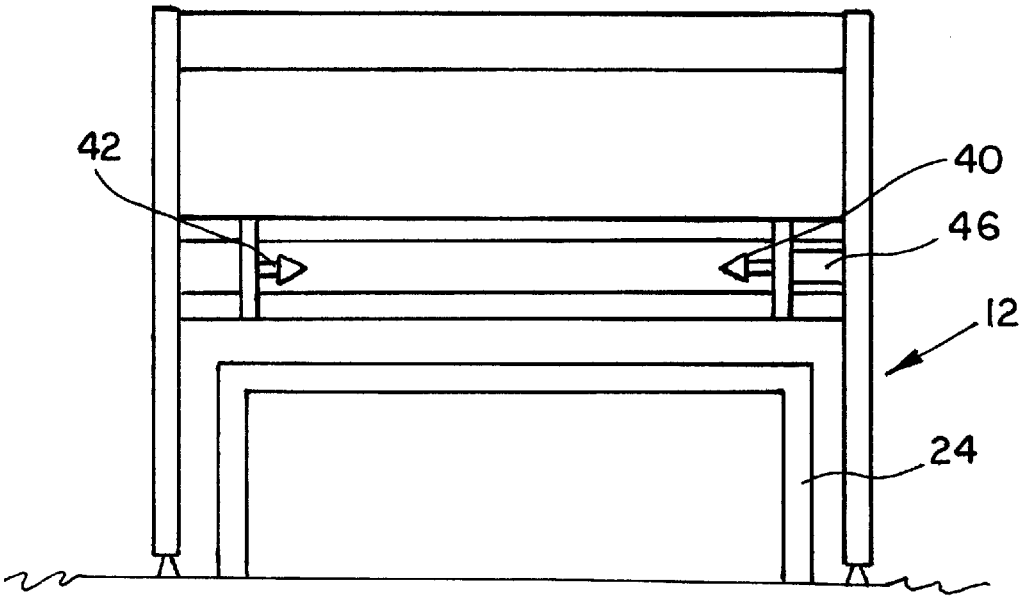
FIG. 3 is an end view of a portion of the fabric spreading machine of the present invention showing the support for the fabric rolls.

Secured to this fabric dispensing support arm (36) for supporting the fabric dispensing assembly (14) is the fabric dispensing assembly (14) itself. The fabric dispensing assembly (14) is comprised of a conical-shaped core support (40), which is centered into one end of the fabric roll (22), a floating idler core element (42), secured to the opposite end of the fabric roll (22), a sensor bar (or dancer bar) (44) and a conventional fabric dispensing drive unit (46), preferably with a variable speed, to dispense the fabric (26) onto the fabric spreading table (24). See FIGS. 2 and 3. The fabric (26) is removed from the fabric rolls (22) and one end of the fabric (26) is secured to the fabric spreading table (24) by a conventional means such as a material clamp (not shown). As the dispensing system frame (12) moves down the track (16), the fabric (26) moves off of the fabric roll (22) and contacts the sensor (or dancer) bar (44), which then energizes the fabric dispensing drive unit (46) to dispense the fabric (26) from the fabric roll (22). The sensor bar (44) is connected to the fabric dispensing drive unit (46) by conventional means to drive the fabric roll (22) and dispense the fabric (26).

In order to be compatible with different lengths of fabric rolls (22), one of the fabric dispensing support arms (36) for supporting the fabric dispensing assembly (14) is preferably secured to a brace (48) running horizontally from one side of the dispensing system frame (12) to the opposite side of the dispensing system frame (12). Movement of one of the fabric dispensing arms (36) along this brace (48) is controlled by a conventional rack and pinion arrangement (not shown) with stops which will permit that fabric dispensing support arm (36) to be secured at any location along the brace (48). By this movement the distance between the conical core support (40) and the idler core element (42) can be adjusted for different sized fabric rolls (22) and also to assist in the loading and unloading of new fabric rolls (22).

The fabric (26) is maintained on conventional fabric rolls (22). The fabric roll (22) is connected between the conical core support (40) and the idler core element (42) of the fabric dispensing assembly (14). The dispensing assembly (14) in operation with the sensor bar (44) unwinds the fabric (26) as the dispensing system frame (12) moves along the track (16).

Figure 4:
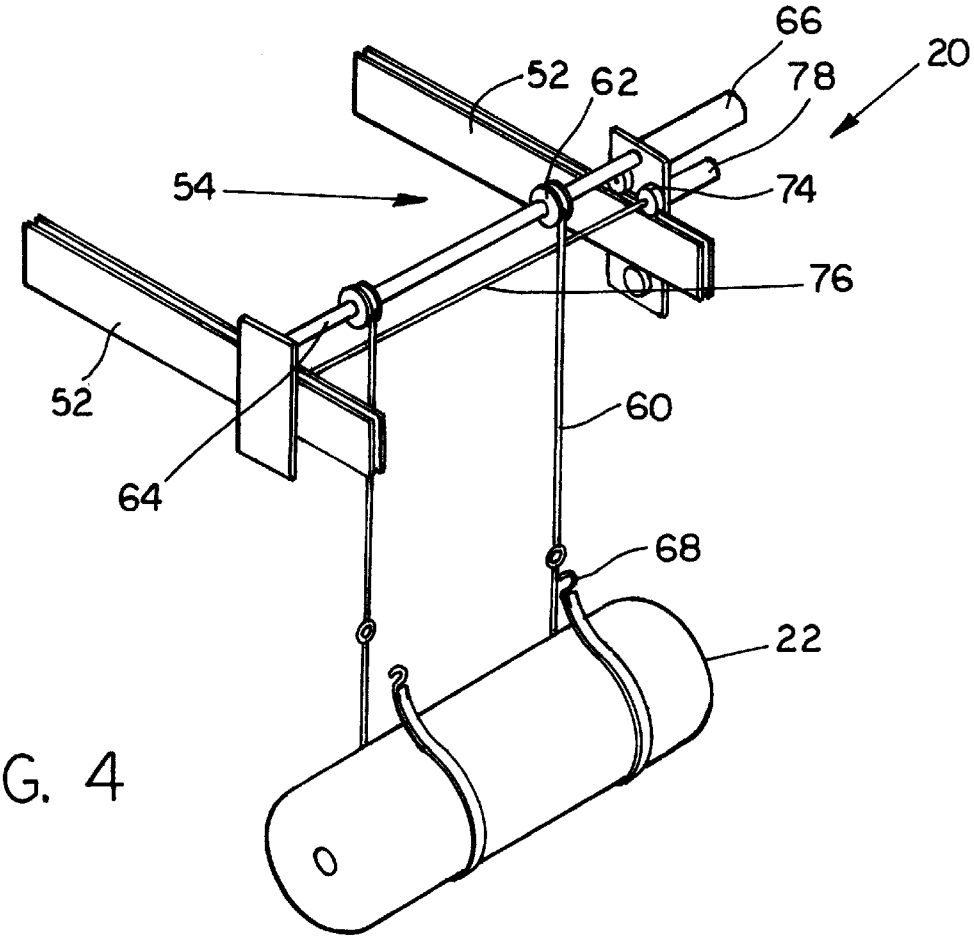
FIG. 4 is a perspective view of the loading and unloading system of the fabric spreading machine of the present invention.

In a preferred embodiment, a loading and unloading system (20) is also secured to the dispensing system frame (12) as shown in FIG. 4. The loading and unloading system (20) is secured to a pair of loading and unloading system support arm (52). Preferably, this loading and unloading system (20) also includes a hoist system (54) to raise and lower the fabric rolls (22), an attachment system to attach the fabric rolls (22) to the hoist system (54) and a movement system to move the hoist system (54), attachment system and fabric rolls (22) along the loading and unloading system support arms (52) until the fabric roll (22) is in position to be connected to the fabric dispensing assembly (14).

In one preferred embodiment the loading and unloading system support arms (52) are each secured to the vertical frame member (34) of the dispensing system frame (12). These support arms (52) are similar in construction to the fabric dispensing support arm (36) of the fabric dispensing assembly (14).

The hoist system (54), which is secured to the loading and unloading system support arms (52), raises and lowers the fabric rolls (22). In one preferred embodiment, the hoist system (54) includes a pair of nylon woven straps (60) connected to spools (62) mounted on a drive shaft (64), connected to a drive system as shown in FIG. 4. The drive system is conventional and in one embodiment includes a double shafted gear box, brake and variable speed motor (66), such as is manufactured by Browning Manufacturing. In use, the straps (60) encircle the support rolls (22) and are moved up and down by the rotation of the drive shaft (64). Safety snaps (68) are connected to the end of the straps (60) to hold the fabric rolls (22) in position.

In one preferred embodiment, the hoist system (54) is moved horizontally along the support arm (52) by a motor drive system. The motor drive system moves along the support arms (52) conventionally, such as by use of a pair of rack and pinion elements (74) which interact with the loading and unloading system support arm (52), a drive shaft (76) passing between the opposite sides of the rack and pinion system (74) and the motor (78) to drive the rack and pinion system (74) along the support arm (52). This type of system is manufactured, for example, by Browning Manufacturing.

Figure 5:
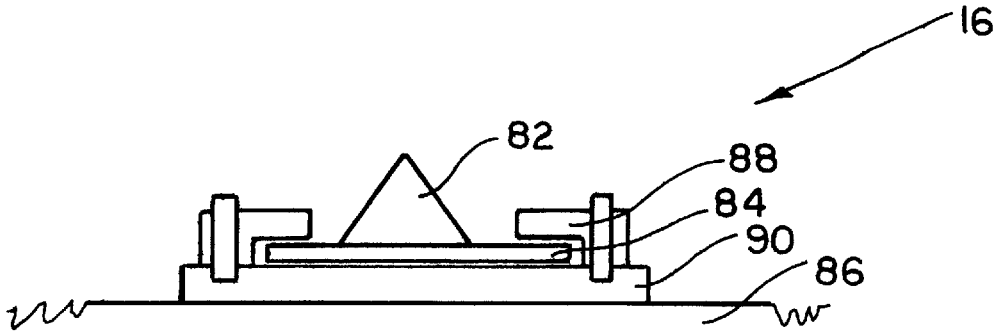
FIG. 5 is an end view of the track of the fabric spreading machine of the present invention.

The floor mounted track (16) can be any type which will support the dispensing system frame (12) and permit it to roll or pass along the track (16) while in use with the fabric spreading table (24). In one preferred embodiment as shown in FIG. 5, the track (16) includes an angle welded part (82), welded in a shape to accept the "V" grooved carrier wheels (30) of the dispensing system frame (12). This angle welded part (82) is preferably then welded to a wider piece of flat bar (84). The flat bar (84) is held in position against the floor (86) by clips (88) bolted to a floor mounted support bar (90) which is itself secured to the floor (86). In a preferred embodiment, the flat bar (84) is held in place by the clips (88) which are themselves bolted to the support bar (90), but are adjusted in width to permit a certain amount of movement of the flat bar (84) between the clips (88) which allows for imperfections in the floor (86) or in the frame (12). The track (16) is generally made of conventional materials, such as heavy duty steel and is manufactures from conventional sources for such products, such as Central Steel and Wire Company of Cincinnati, Ohio.

Because the dispensing system frame (12) holds all of the weight of the dispensing system frame (12), the fabric dispensing assembly (14), and the fabric roll (22), the fabric dispensing table (24) can be constructed lighter in weight as it need only support the fabric (26) being cut. This type of lighter weight fabric dispensing table (24) is far less expensive than conventional fabric spreading tables which are used with conventional fabric spreading machines.

In operation, the fabric roll (22) is first secured to the dispensing system frame (12). In a preferred embodiment, this fabric roll (22) is secured to the dispensing system frame (12) by securing it to the loading and unloading system (20), which is itself secured to the dispensing system frame (12). The fabric roll (22) is raised by the hoist system (54) of the loading and unloading system (20) to the position necessary for securing it to the fabric dispensing assembly (14). The fabric roll (22) is then secured between the conical core support (40) and the floating idler arm element (42) of the fabric dispensing assembly (14). The fabric (26) is then threaded through the fabric dispensing assembly (14) around the sensor bar (44). One end of the fabric (26) is then secured to one end of the table. The drive system of the fabric spreading machine (10) is then activated to move the dispensing system frame (12) along the floor mounted track (16). As the dispensing system frame (12) moves along the track (16), the fabric (26) moves the sensor bar (44) that energizes the fabric dispensing drive unit (46) that unrolls the fabric (26). At the end of the table (24), the fabric (26) is cut to fit on the size and shape of the table (24). The drive system for the dispensing system frame (12) is then reversed to move the dispensing system frame (12) back to the first end of the table (24) where the end of the cut fabric (26) is then secured once again in place to that end of the table. Once the fabric (26) is completely removed from the fabric roll (22), a new fabric roll (22) is raised in place by use of the loading and unloading system (20), which is secured to the dispensing system frame (12).

It will be apparent from the foregoing that while particular forms of the invention have been illustrated and described, various modifications can be made without departing from the spirit and scope of the invention.

What is claimed is:

1. A fabric spreading machine comprising (a) a track directly secured to a floor of a building in which the machine is utilized, (b) a dispensing system frame supported on the track, (c) a fabric dispensing assembly secured to the frame, and (d) a drive system secured to the frame for traversing the frame across the track.

2. The fabric spreading machine of claim 1 further comprising a fabric roll loading and unloading system secured to the frame.

3. The fabric spreading machine of claim 1 wherein the fabric dispensing assembly comprises a fabric dispensing drive and spindles secured to the dispensing system frame.

4. The fabric spreading machine of claim 1 further comprising a fabric spreading table.

5. The fabric spreading machine of claim 1 wherein the dispensing system frame comprises a fabric dispensing assembly support, frame support members and carrier wheels which move on the floor mounted track.

6. The fabric spreading machine of claim 5 further comprising a loading and unloading system.

7. The fabric spreading machine of claim 1 wherein the dispensing system frame comprises a horizontal frame member containing drive wheels, a vertical frame member, and a fabric dispensing support arm.

8. The fabric spreading machine of claim 7 is further comprising a loading and unloading system.

9. A fabric spreading machine comprising (a) a floor mounted track, (b) a dispensing system frame supported on the track, (c) a fabric dispensing assembly secured to the frame, (d) a drive system secured to the frame for traversing the frame across the track, and (e) a fabric roll loading and unloading system secured to the frame, wherein the loading and unloading system comprises a hoist, an attachment system to attach the hoist to the frame and a drive system to drive the hoist on the frame.

10. A fabric spreading machine comprising (a) a floor mounted track, (b) a dispensing system frame supported on the track, (c) a fabric dispensing assembly secured to the frame, (d) a drive system secured to the frame for traversing the frame across the track, and (e) a loading and unloading system, wherein the dispensing system frame comprises a drive system, a fabric dispensing support, frame support members and carrier wheels which move on the floor mounted track, and wherein the loading and unloading system comprises a hoist, an attachment system to attach the hoist to the frame and a drive system to drive the hoist on the frame.

11. A fabric spreading machine comprising (a) a floor mounted track, (b) a dispensing system frame supported on the track, (c) a fabric dispensing assembly secured to the frame, and (d) a drive system secured to the frame for traversing the frame across the track, wherein the floor mounted track comprises an angle welded part, secured to a flat bar which is secured to the floor.

12. A fabric spreading machine comprising (a) a floor mounted track, (b) a dispensing system frame supported on the track, (c) a fabric dispensing assembly secured to the frame, and (d) a drive system secured to the frame for traversing the frame across the track, wherein the floor mounted track comprises a flat bar secured to the floor, a pair of clips secured to the flat bar, and an angle welded part secured to the flat bar by the clips.

13. A fabric spreading machine comprising (a) a floor mounted track, (b) a dispensing system frame supported on the track, (c) a fabric dispensing assembly secured to the frame, (d) a drive system secured to the frame for traversing the frame across the track, and (e) a loading and unloading system, wherein the dispensing system frame comprises a horizontal frame member containing drive wheels, a vertical frame member, and a fabric dispensing support arm, and wherein the loading and unloading system comprises a hoist, an attachment system to attach the hoist to the frame and a drive system to drive the hoist on the frame.

* * * * *